US008469736B2

(12) United States Patent
Pan et al.

(10) Patent No.: US 8,469,736 B2
(45) Date of Patent: Jun. 25, 2013

(54) AUDIO TEST CABLE

(75) Inventors: Jian-Chun Pan, Shenzhen (CN); Hai-Qing Zhou, Shenzhen (CN); Yi-Xin Tu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 38 days.

(21) Appl. No.: 13/277,223

(22) Filed: Oct. 20, 2011

(65) Prior Publication Data

US 2013/0059464 A1 Mar. 7, 2013

(30) Foreign Application Priority Data

Sep. 5, 2011 (CN) ..... 2011 1 0260320

(51) Int. Cl.
*H01R 11/00* (2006.01)
*H01R 31/06* (2006.01)

(52) U.S. Cl.
CPC ..... *H01R 31/06* (2013.01)
USPC ..... 439/502

(58) Field of Classification Search
USPC ..... 439/502, 638, 188, 498, 225; 174/72 R, 174/74 R, 88 R
See application file for complete search history.

(56) References Cited

U.S. PATENT DOCUMENTS

| | | | | |
|---|---|---|---|---|
| 5,118,309 | A * | 6/1992 | Ford | 439/620.21 |
| 5,439,390 | A * | 8/1995 | Raynor et al. | 439/502 |
| 6,907,615 | B1 * | 6/2005 | Alexander et al. | 725/80 |
| 7,200,856 | B2 * | 4/2007 | Perlman | 725/82 |
| 7,465,187 | B1 * | 12/2008 | Wu | 439/502 |
| 7,736,193 | B2 * | 6/2010 | Edeler et al. | 439/675 |
| 7,783,801 | B2 * | 8/2010 | Lin | 710/65 |
| 2003/0211775 | A1 * | 11/2003 | Marchand et al. | 439/502 |
| 2009/0061678 | A1 * | 3/2009 | Minoo et al. | 439/502 |

* cited by examiner

*Primary Examiner* — Edwin A. Leon
*Assistant Examiner* — Harshad Patel
(74) *Attorney, Agent, or Firm* — Altis Law Group, Inc.

(57) ABSTRACT

An audio test cable includes three types of audio input and output (I/O) ports. The input port and the output port in each type of audio I/O ports form a short circuit for carrying a loopback test for a motherboard. The audio test cable also includes a test audio jack which connects to the output port of all types of audio I/O ports for carrying out an audio-quality test for the motherboard.

1 Claim, 3 Drawing Sheets

AUDIO TEST CABLE

BACKGROUND

1. Technical Field

The present disclosure relates to test devices and, particularly, to an audio test cable.

2. Description of Related Art

Motherboards typically include audio input and output (I/O) ports for inputting and outputting audio signals. After being assembled, the motherboards need to pass various audio tests to ensure quality. However, there are three types of audio I/O ports, such as an audio jack, a pin header, and a jack and socket (JST), and two types of audio tests, such as a loopback test and an audio-quality test, and each type of audio I/O ports requires a corresponding cable to conduct each type of audio test. As such, six types of cables are required by the audio tests, which is inconvenient.

Therefore, it is desirable to provide an audio test cable, which can overcome the above-mentioned problems.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the present disclosure will now be described in detail with reference to the drawings.

Figure 1:
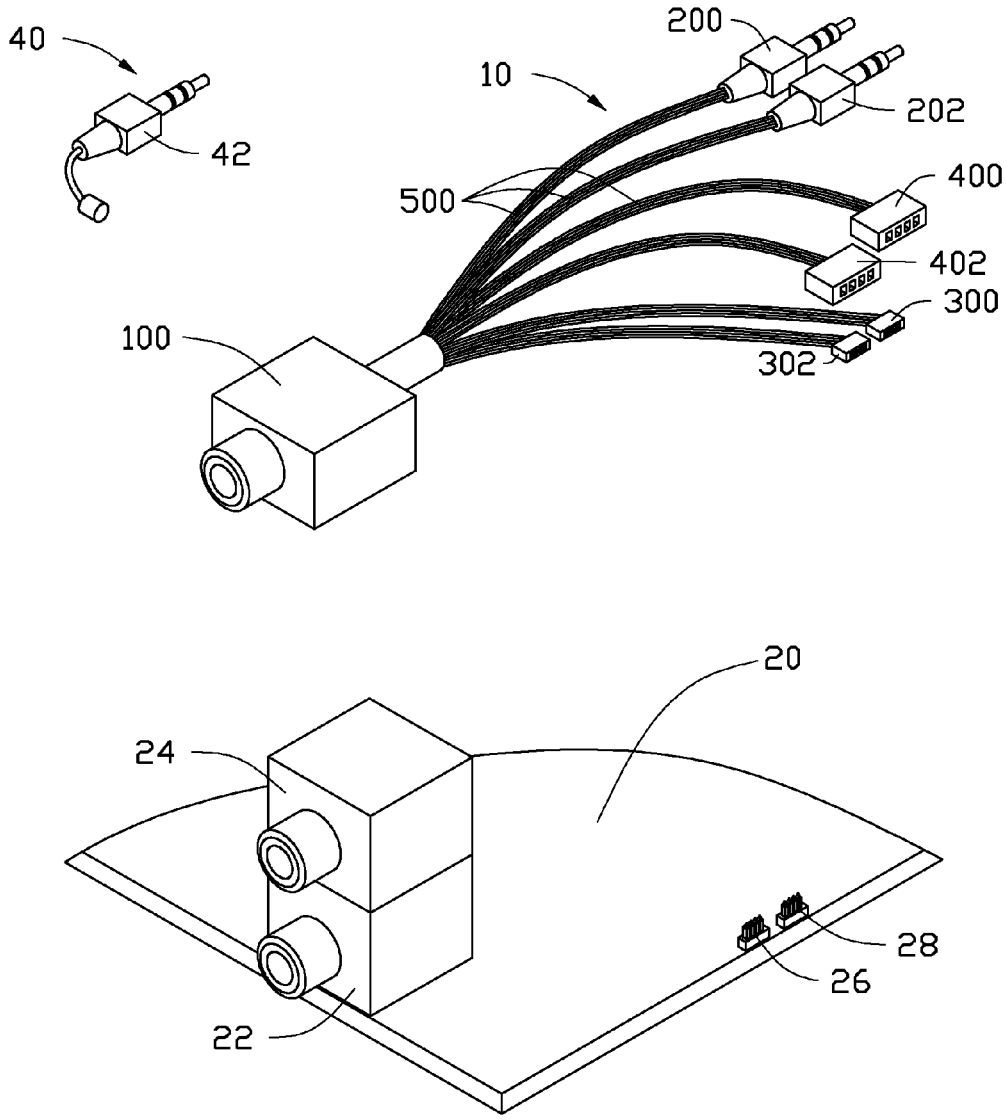
FIG. 1 is an isometric schematic view of a test cable and a motherboard, according to an embodiment.
Figure 3:
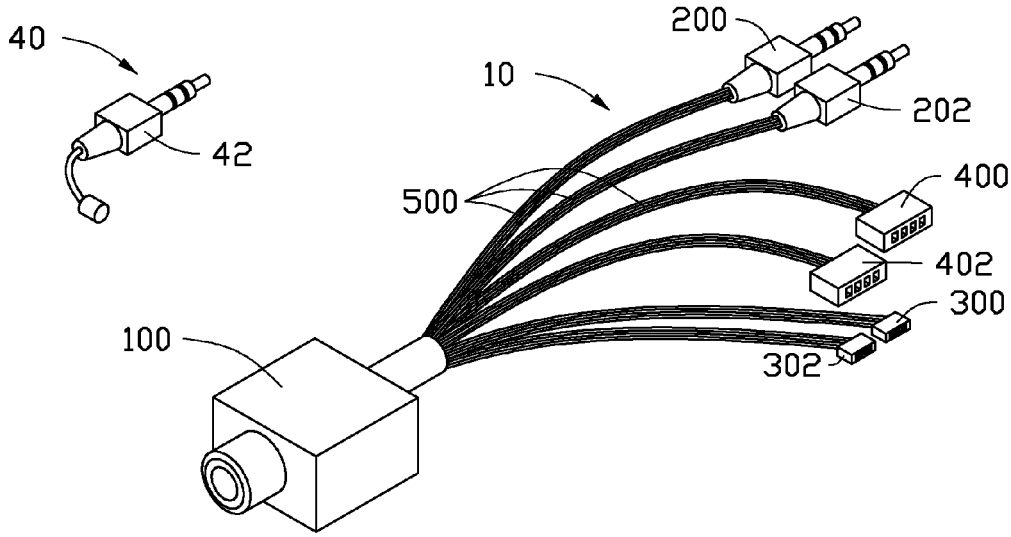
FIG. 3 is an isometric schematic view of a test cable and a motherboard, according to another embodiment.
Figure 3:
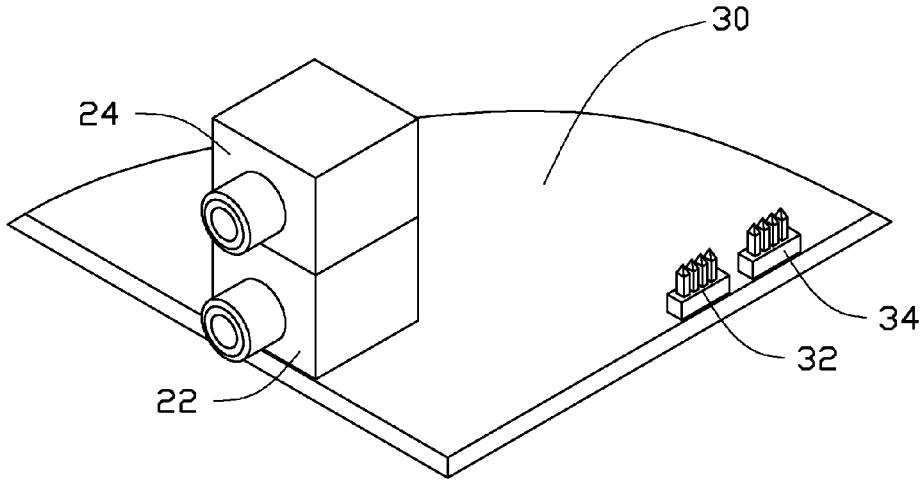

Referring to FIG. 1, a test cable 10, according to an embodiment, carries out audio tests, including a loopback test and an audio-quality test, for a motherboard 20. The motherboard 20 includes an input audio jack 22 for inputting audio signals, an output audio jack 24 for outputting audio signals, an input pin header 26 for inputting audio signals, and an output pin header 28 for outputting audio signals. Also referring to FIG. 3, in another embodiment, the test cable 10 can be used to carry out the audio tests for another motherboard 30. The motherboard 30 includes, instead of the input pin header 26 and the output pin header 28, an input JST 32 for inputting audio signals and an output JST 34 for outputting audio signals. In practice, almost all the motherboards employ the audio jacks, the pin headers, and/or the JSTs as audio I/O ports.

Each of the input audio jack 22 and the output audio jack 24 defines a hole of a 3.5 mm diameter (that is, the input audio jack 22 and the output audio jack 24 are 3.5 mm audio jack) and each includes a left channel (LC) positive terminal, a right channel (RC) positive terminal, and two grounding terminals extending in the hole and connected to an audio processing chip of the motherboard 20 and 30.

The input pin header 26 and the output pin header 28 each include an LC positive pin, an RC positive pin, and two grounding pins arranged in a line at a 2 mm pitch.

The input JST 32 and the output JST 34 each include an LC positive pin, an RC positive pin, and two grounding pins arranged in a line at a 2.54 mm pitch.

To conduct the loopback test for the motherboard 20 or 30, each audio input port, such as the input audio jack 22, the input pin header 26, or the input JST 32, should form a short circuit with a corresponding audio output port, such as the output audio jack 24, the output pin header 28, or the output JST 34. As such, test audio signals can be sent out from the motherboard 20 or 30 via the audio output port and back to the motherboard 20 or 30 via the corresponding audio input port to detect if there is data loss in the transmission of the test audio signals. If there is no data loss, the motherboard 20 or 30 passes the loopback test. If no, the motherboard 20 or 30 is rejected.

To conduct the audio-quality test for the motherboard 20 or 30, each audio output port, such as the output audio jack 24, the output pin header 28, or the output JST 34 should be connected to a speaker 40 (or an earphone). Test audio signals are sent to and played by the speaker 40 (or the earphone) to determine if the audio-quality is acceptable. If yes, the motherboard 20 or 30 passes the audio-quality test. If no, the motherboard 20 or 30 is rejected.

Figure 2:
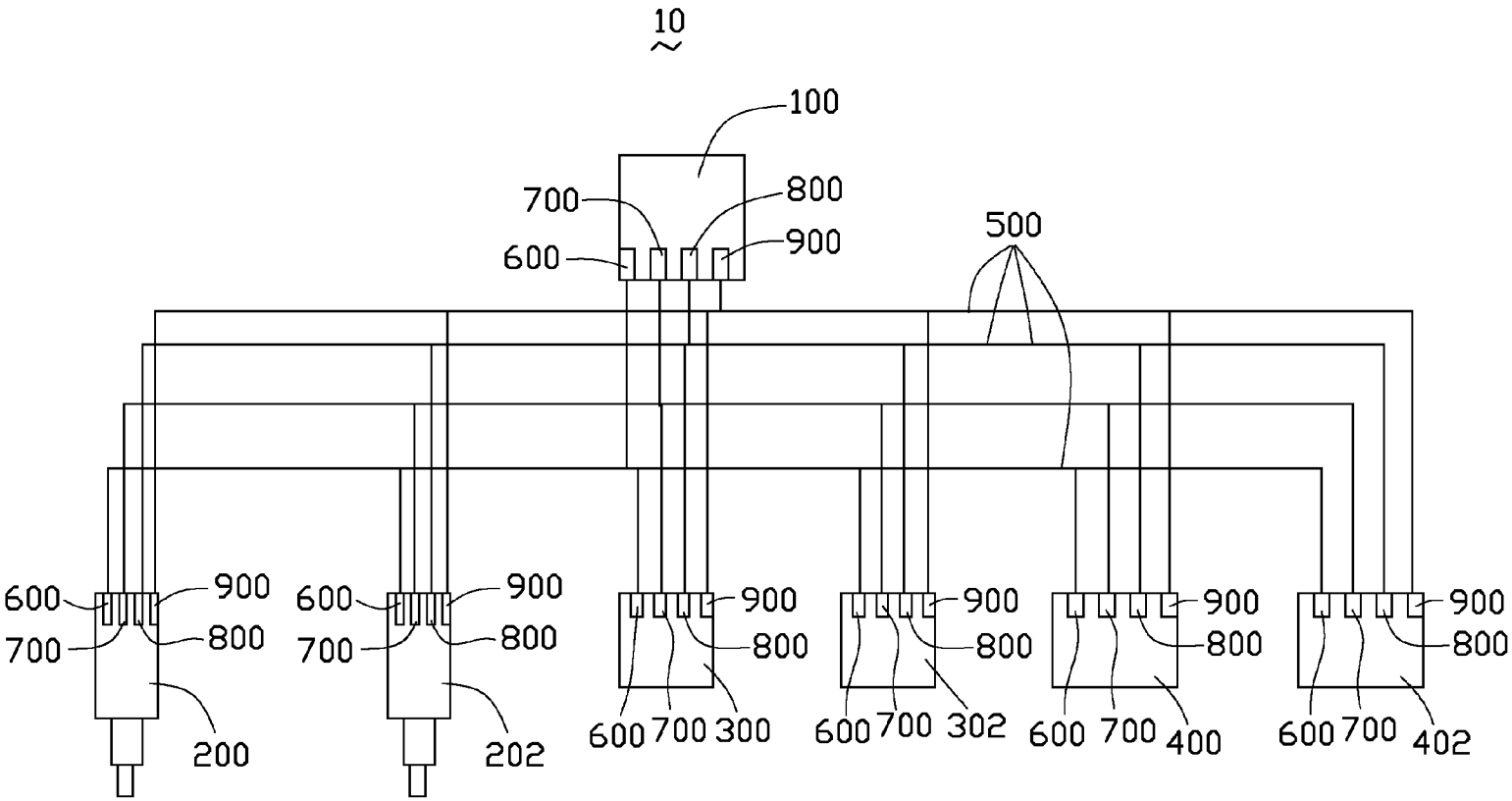
FIG. 2 is a schematic view of the audio test cable of FIG. 1.

Also referring to FIG. 2, the test cable 10 includes a test audio jack 100, an input audio connector (i.e., a plug) 200 mating with the input audio jack 22, an output audio connector 202 mating with the output audio jack 24, an input pin header socket 300 mating with the input pin header 26, an output pin header socket 302 mating with the output pin header 28, an input JST female 400 mating with the input JST 32, an output JST female 402 mating with the output JST 34, a number of cables 500. Each of the test audio jack 100, the input audio connector 200, the output audio connector 202, the input pin header socket 300, the output pin header socket 302, the input JST female 400 and the output JST female 402 includes an LC positive terminal 600, an RC positive terminal 700 and two grounding terminals 800 and 900. The LC positive terminals 600 form a short circuit using the cables 500, the RC positive terminals 700 form a short circuit using the cables 500, the grounding terminals 800 form a short circuit using the cables 500, the grounding terminals 900 form a short circuit using the cables 500.

As such, the test cable 10 can mate with the three main types of audio I/O ports of motherboards using the input audio connector 200, the output audio connector 202, the input pin header socket 300, the output pin header socket 302, the input JST female 400 and output JST female 402. After the test cable 10 is mated with each type of I/O ports of the motherboard 20 or 30, the LC positive terminal/pin, the RC positive terminal/pin and the grounding terminal/pins of the audio input port form respective short circuits with those of the audio output port. As such, the loopback test can be carried out. After the speaker 40 is mated with a specific type of audio output port using a test audio connector 42, the audio-quality test can be carried out. That is, the test cable 10 can be used for both the three types of audio I/O ports and the two main audio tests.

The above particular embodiments are shown and described by way of illustration only. The principles and the features of the present disclosure may be employed in various and numerous embodiments thereof without departing from the scope of the disclosure as claimed. The above-described embodiments illustrate the possible scope of the disclosure but do not restrict the scope of the disclosure.

What is claimed is:

1. A test cable, comprising:

a test audio jack for mating with a test audio connector of a speaker or an earphone;

an input audio connector for mating with an input audio jack of a motherboard;

an output audio connector for mating with an output audio jack of a motherboard;

an input pin header socket for mating with an input pin header of a motherboard;

an output pin header socket for mating with an output pin header of a motherboard;

an input jack and socket (JST) female for mating with an input JST of a motherboard;

an output JST female for mating with an output JST of a motherboard; and a plurality of cables;

wherein each of the test audio jack, the input audio connector, the output audio connector, the input pin header socket, the output pin header socket, the input JST female, and the output JST female comprises a left channel (LC) positive terminal, a right channel (RC) positive terminal and two grounding terminals, the LC positive terminals form a short circuit using the cables, the RC positive terminals form a short circuit using the cables, and the grounding terminals form a short circuit using the cables.

* * * * *